US006759585B2

(12) United States Patent
Hatanaka

(10) Patent No.: US 6,759,585 B2
(45) Date of Patent: Jul. 6, 2004

(54) MUSICAL-FILE-PROCESSING APPARATUS, MUSICAL-FILE-PROCESSING METHOD AND MUSICAL-FILE-PROCESSING METHOD PROGRAM

(75) Inventor: Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 46 days.

(21) Appl. No.: 10/174,623

(22) Filed: Jun. 18, 2002

(65) Prior Publication Data

US 2003/0015085 A1 Jan. 23, 2003

(30) Foreign Application Priority Data

Jun. 19, 2001 (JP) ..... 2001-184666

(51) Int. Cl.[7] ..... G10H 1/46; G10H 7/00

(52) U.S. Cl. ..... 84/633

(58) Field of Search ..... 84/633, 665

(56) References Cited

PUBLICATIONS

Windows Media Player 9 Series Reviewer's Guide, Dec. 23, 2002, pp. 9,19,40.*

Press release, "Musicmatch debuts the Music Fan's Media Player" Oct. 23, 2001.*

* cited by examiner

*Primary Examiner*—Jeffrey W. Donels

(74) *Attorney, Agent, or Firm*—Frommer Lawrence & Haug LLP; William S. Frommer; Samuel H. Megerditchian

(57) ABSTRACT

The present invention relates to a musical-file-processing apparatus, a musical-file-processing method and a musical-file-processing method program. The present invention can be applied to a case in which, for example, musical files are stored typically in a personal computer to be reproduced later. Each musical file is recorded by detecting a recording level of the file and the file is reproduced with the volume of the file corrected on the basis of the detected level so that complicated operations can be avoided and recorded musical files with different recording level can each be reproduced at a proper volume.

11 Claims, 12 Drawing Sheets

MUSICAL-FILE-PROCESSING APPARATUS, MUSICAL-FILE-PROCESSING METHOD AND MUSICAL-FILE-PROCESSING METHOD PROGRAM

BACKGROUND OF THE INVENTION

The present invention relates to a musical-file-processing apparatus, a musical-file-processing method and a musical-file-processing method program. The present invention can be applied to a case in which, for example, musical files are stored typically in a personal computer to be reproduced later. Each musical file is recorded by detecting a recording level of the file and the file is reproduced with the volume of the file corrected on the basis of the detected recording level so that complicated operations can be avoided and recorded musical files with different recording levels can each be reproduced at a proper volume.

Traditionally, music is presented to the user by using a compact disc and the user listens to the music at a desired volume by operating an audio apparatus.

In recent years, in a personal computer, there is provided an application program for reproducing pieces of music one after another automatically or in a desired order, whereby a large number of music files (hereinafter referred to as musical files) presented to the user by means of a compact disc can be stored in a personal computer.

By the way, pieces of music are presented to the user by using compact discs at recording levels greatly varying from disc to disc in some cases. In particular, music stored previously on a record and then re-recorded onto a compact disc to be presented to the user is characterized in that the recording level of the music is low in comparison with music presented by using a compact disc in recent years. It should be noted that, in the case of music with a low recording level, a dynamic range of a transmission line including a recording medium is not utilized effectively.

In order to listen to such music typically by reproducing the music by treating a recording medium such as a compact disc as a reproduction unit, the volume can be adjusted at a point of time the beginning piece of music on the compact disc is reproduced so that the user can listen to pieces of music recorded on the compact disc at an almost appropriate level. In addition, when listening music from FM broadcasting or the like, the user can enjoy the music without the need to adjust the volume since a station broadcasting the music adjusts the level.

If a large number of musical files are downloaded into a personal computer from various kinds of recording media to be stored in a storage unit employed in the personal computer and the large number of stored files are automatically reproduced later on, however, the pieces of music stored will be reproduced at different recording levels, raising a problem of a great difficulty to adjust the volume of reproduction. If the volume of reproduction is not adjusted, however, a piece of music stored at a low recording level will be hard to listen to.

SUMMARY OF THE INVENTION

It is thus an object of the present invention addressing the problem described above to provide a musical-file-processing apparatus, a musical-file-processing method and a musical-file-processing method program, which are capable of reproducing musical files with different recording levels at an appropriate volume by effectively eliminating complex operations and provide a program for implementing the audio-signal-processing method.

In carrying out the invention and according to a first aspect thereof, there is provided a musical-file-processing apparatus for acquiring and storing a musical file wherein a recording level is detected for each of the musical file and the result of detection is recorded in association with the corresponding musical file.

With this configuration, a recording level of each musical file is detected and the musical file is recorded by associating the file with a result of detection. Thus, by correcting the volume of each reproduced musical file in accordance with a result of the detection of the recording level, variations in volume from file to file can be eliminated. As a result, a cumbersome operation to adjust the volume of each reproduced musical file can be avoided and musical files with different recording levels can be reproduced at an appropriate volume.

According to another aspect of the invention, there is provided a musical-file-processing apparatus for reproducing a musical file wherein a musical-file is reproduced with the volume corrected in accordance with a result of detection of a recording level for the musical file.

With this configuration, a musical file is reproduced by correcting the volume of the file in accordance with a result of detection of the file's recording level. By detecting recording levels in each of a variety of apparatus, a cumbersome operation to adjust the volume of each reproduced musical file can be avoided and musical files with different recording levels can be reproduced at an appropriate volume.

According to a third aspect of the invention, there is provided a musical-file-processing method for acquiring and storing a musical file, said musical-file-processing method comprising: a recording level detecting step for each of the musical file; and a musical file recording step by associating the musical file with a result of detection obtained in said recording level detecting step.

According to a fourth aspect of the invention, there is provided a musical-file-processing method for reproducing a musical file, wherein a musical file is reproduced with the volume corrected in accordance with a result of detection of a recording level for the musical file.

With these configurations, a cumbersome operation to adjust the volume of each reproduced musical file can be avoided and musical files with different recording levels can be reproduced at an appropriate volume.

According to a fifth aspect of the invention, there is provided a program implementing a musical-file-processing method for acquiring and storing a musical file, said musical-file-processing method comprising: a recording level detecting step for each of the musical file; and a musical file recording step by associating the musical file with a result of detection obtained in said recording level detecting step.

According to a sixth aspect of the invention, there is provided a program implementing a musical-file-processing method for reproducing; a musical file, wherein a musical file is reproduced with the volume corrected in accordance with a result of detection of a recording level for the musical file.

With these configurations, a cumbersome operation to adjust the volume of each reproduced musical file can be avoided and musical files with different recording levels can be reproduced at an appropriate volume.

The above and other objects, features and advantages of the present invention will become apparent from the following description and the appended claims, taken in conjunction with the accompanying drawings in which like parts or elements denoted by like reference symbols.

PREFERRED EMBODIMENTS OF THE INVENTION

A preferred embodiment of the present invention is described in detail by referring to diagrams as follows.

Figure 2:
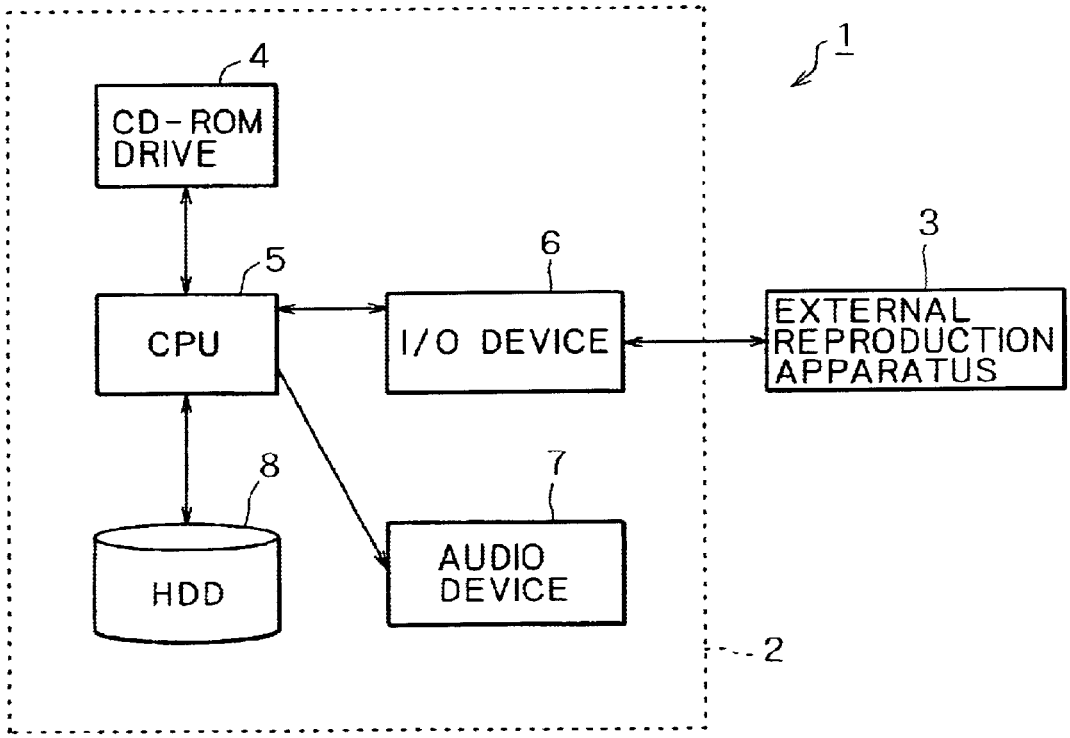
FIG. 2 is a block diagram showing the musical-file-processing system implemented by the embodiment of the present invention.

FIG. 2 is a block diagram showing a musical-file-processing system 1 implemented by an embodiment of the present invention. In the musical-file-processing system 1, a personal computer 2 is used for storing musical files. The personal computer 2 is also capable of reproducing a stored musical file for listening by the user. In addition, the personal computer 2 is also capable of downloading a musical file to an external reproduction apparatus 3 to be listened to by the user through the external reproduction apparatus 3.

That is to say, in the personal computer 2, a CD-ROM drive 4 is controlled by a central processing unit (CPU) 5 to reproduce a musical file from a compact disc or the like and output a result of reproduction to the central processing unit 5 as well as to record various kinds of data onto a CD-R or the like. An I/O device 6 is an interface for a USB (Universal Serial Bus), the IEEE1394 or others. The I/O device 6 is used for transmitting and receiving various kinds of data to and from the external reproduction apparatus 3. Employed in the personal computer 2, an audio device 7 is a component contributing to reproduction of a musical file. The audio device 7 comprises components including a digital-analog conversion circuit, an amplification circuit and a speaker.

A hard-disc drive (HDD) 8 is used for storing programs to be executed by the central processing unit 5 and musical files obtained through the CD-ROM drive 4. The hard-disc drive 8 is also capable of outputting data stored therein. The central processing unit 5 executes a predetermined application program stored in the hard-disc drive 8 to download a musical file from the CD-ROM drive 4 to the hard-disc drive 8, forming a database of musical files. The central processing unit 5 also executes the predetermined program to output a musical file of this database to, for example, the external reproduction apparatus 3. It should be noted that, besides the functional blocks shown in FIG. 2, the personal computer 2 has a communication function using a modem and other components, which are included in an ordinary personal computer. In addition, the personal computer 2 also has a variety of interfaces such as a keyboard, a mouse and a display unit.

This application program is a program for reproducing musical files recorded in the database as described above automatically or in accordance with the user setting in a sequential manner. When the user enters a command to invoke this application program, the central processing unit 5 displays a main screen of this program. When the user enters a command to download musical files from a compact disc onto the hard-disc drive 8 to the main screen, the musical files are reproduced from the compact disc mounted in the CD-ROM drive 4 under control executed by the CD-ROM drive 4 and the musical files obtained as a result of the reproduction are recorded onto the hard-disc drive 8, being stored in the database. At that time, the central processing unit 5 records each piece of music onto the hard-disc drive 8 in accordance with a processing procedure represented by a flowchart shown in FIG. 1 so that the musical files are recorded on the hard-disc drive 8 in a predetermined format and stored in the database by detecting the recording level of each of the musical files.

To put in detail, when the central processing unit 5 starts reproduction of a musical file from a compact disc mounted on the CD-ROM drive 4 on the basis of TOC (Table Of Contents) information obtained from the compact disc, the flow of the processing procedure goes on from a step SP1 to a step SP2 at which a maximum level variable Lev is set at an initial value of 0. The maximum level variable Lev is a criterion variable for forming a judgment on the recording level of a musical file, which is handled as a processing object. The maximum level variable Lev of a musical file is a value representing a maximum amplitude of the musical file.

After the central processing unit 5 initializes the maximum level variable Lev, the flow of the processing procedure goes on to a step SP3 at which the central processing unit 5 forms a judgment as to whether or not input data has been received. If input data has been received, the flow of the processing procedure goes on to a step SP4 at which audio data is extracted from the data output by the CD-ROM drive 4. Then, at the next step SP5, the central processing unit 5 detects the amplitude Lev New of the extracted audio data. It should be noted that the central processing unit 5 detects the amplitude Lev New by converting the signal level of the audio data into an absolute value. The audio data extracted in this way is referred to as linear PCM (Pulse Code Modulation) data. Then, at the next step SP6, the central processing unit 5 forms a judgment as to whether or not the detected amplitude Lev New is greater than the maximum level variable Lev. If the central processing unit 5 finds out that the detected amplitude Lev New is greater than the maximum level variable Lev, the flow of the processing procedure goes on to a step SP7 at which the maximum level variable Lev is set at the detected amplitude Lev New. Then, the flow of the processing procedure goes on to a step SP8. If the detected amplitude Lev New is not greater than the maximum level variable Lev, on the other hand, the flow of the processing procedure goes on directly to the step SP8.

At the step SP8, the central processing unit 5 encodes this linear-PCM audio data in a format selected by the user and records the encoded data onto the hard-disc drive 8. Then, the flow of the processing procedure goes on to the step SP3. It should be noted that the selected format is normally a format according to an ATRAC (Adaptive Transform Acoustic Coding) technique.

The central processing unit 5 thus repeatedly executes the processing procedure in the order of the it, steps SP3–SP4–SP5–SP6–SP8–SP3 or the steps SP3–SP4–SP5–SP6–SP7–SP8–SP3 to determine the maximum amplitude of a musical file, which is handled as a processing object, from sequentially detected amplitudes of the musical file. As the reproduction of a piece of music is finished, the outcome of the judgment formed at the step SP3 is lead to a negation, which causes the flow of the processing procedure to go on to a step SP9. At this step, the detected maximum amplitude is recorded in the database. Then, at the next step SP10, the processing procedure is ended.

In this way, the central processing unit 5 detects a recording level from audio data obtained by the so-called linear PCM and compiles the detected recording level into the database. The recording level is the maximum amplitude detected by the central processing unit 5. The central processing unit 5 stores the recording level in the database along with the number of quantization bits or a quantization-bit count.

Figure 3:
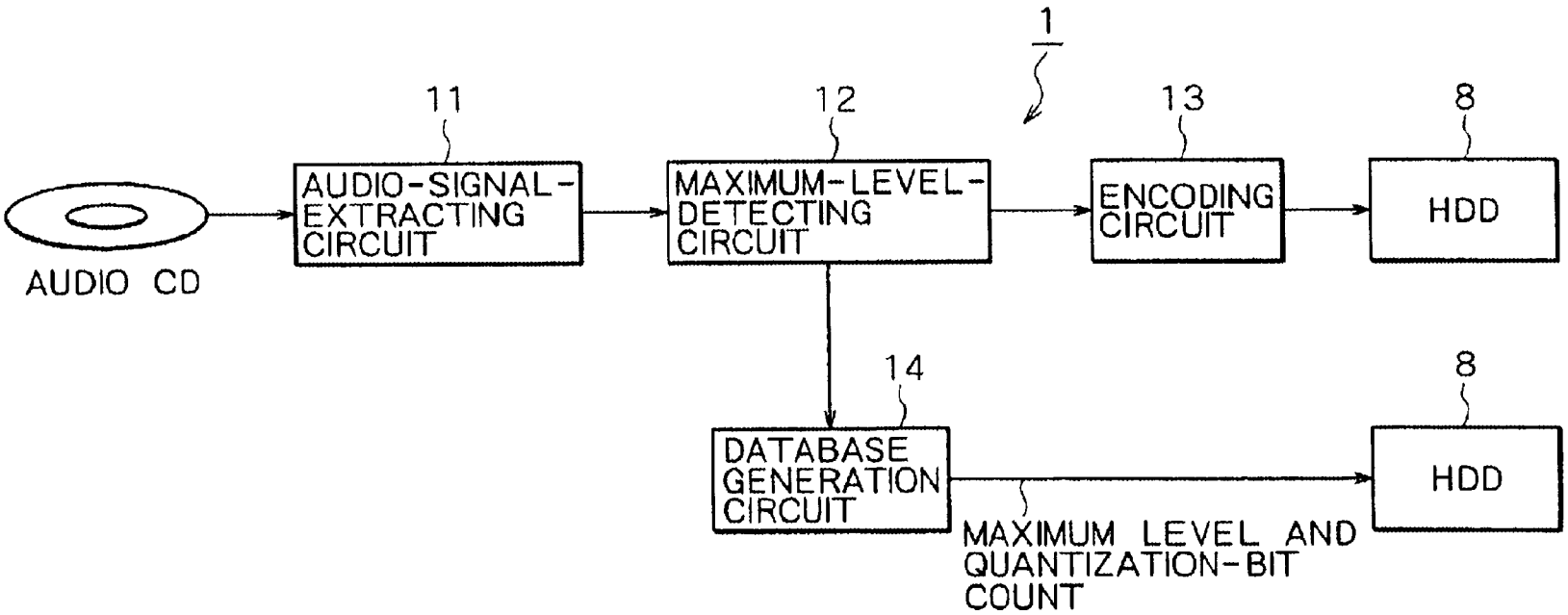
FIG. 3 is a functional block diagram showing the personal computer's components required for carrying out the processing procedure shown in FIG. 1.

FIG. 3 is a functional block diagram showing components of the personal computer 2 that are required for carrying out the above sequential processing. In the functional blocks shown in FIG. 3, an audio-signal-extracting circuit 11 is a functional block for extracting audio data from data output by the CD-ROM drive 4 and a maximum-level-detecting circuit 12 is a functional block for detecting a maximum amplitude from this audio data. An encoding circuit 13 is a functional block for encoding the audio data in accordance with the ATRAC technique and storing the encoded data onto the hard-disc drive 8, and a database generation circuit 14 is a functional block for recording a maximum level and a quantization-bit count onto the hard-disc drive 8 and compiling them into a database.

If the user enters a command to import a piece of music to the main screen of the application program and conversion of the format of imported audio data is not required, on the other hand, the musical file specified in the command entered by the user is merely stored in the database. In this case, the central processing unit 5 carries out processing represented by a procedure shown in FIG. 4 to acquire a recording level of the audio data and record the recording level into the database for each piece of music. It is to be noted that an import operation defined by this application program is a process to set a musical file so that the file can be used by the program. In this embodiment, a musical file already recorded in the hard-disc drive 8 and a musical file generated from an audio signal obtained from an external apparatus connected to an external input terminal is each an object of the import processing. Thus, in the explanation of the processing procedure shown in FIG. 4, an audio signal obtained from the external apparatus is assumed to have been processed by a sound board or the like. By the way, if a linear-PCM audio signal is obtained in processing carried out by using a sound board or the like, the central processing unit 5 detects a recording level of the audio signal in the same way as what are explained by referring to FIGS. 1 and 3, recording the level in the database along with the musical file for the audio signal.

Figure 4:
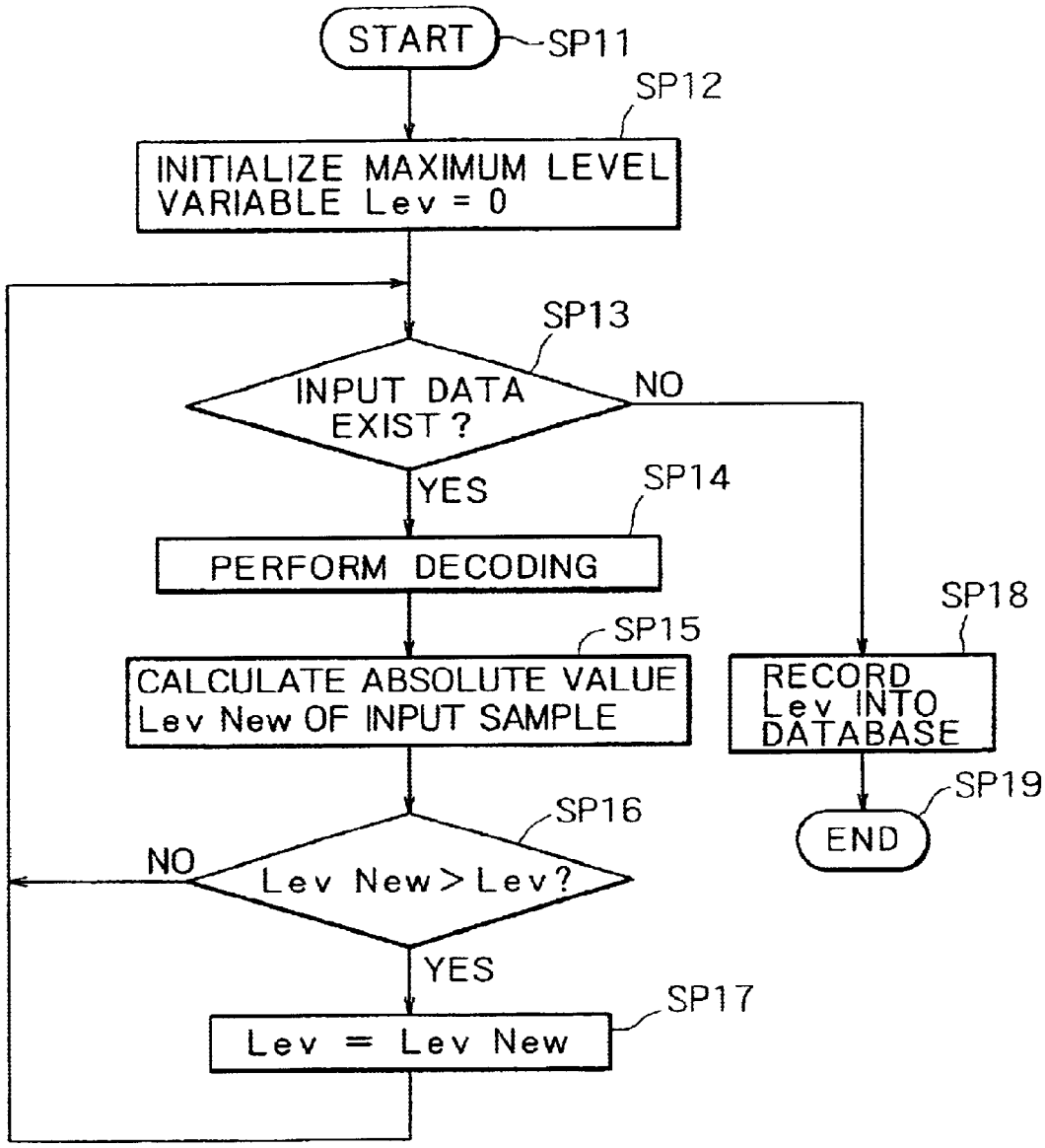
FIG. 4 is a flowchart representing the procedure of processing to import a musical file.

To put it in detail, the processing procedure shown in FIG. 4 begins with a step SP11 at which the central processing unit 5 starts processing of a musical file specified in a command entered by the user. Then, at the next step SP12, a maximum level variable Lev is set at an initial value of 0. Subsequently, the flow of the processing procedure goes on to a step SP13 at which the central processing unit 5 forms a judgment as to whether or not input data has been received. If input data has been received, the flow of the processing procedure goes on to a step SP14 at which audio data is decoded into linear PCM data.

Then, at the next step SP15, the central processing unit 5 detects the amplitude Lev New of the decoded audio data. Subsequently, at the next step SP16, the central processing unit 5 forms a judgment as to whether or not the detected amplitude Lev New is greater than the maximum level variable Lev. If the central processing unit 5 finds out that the detected amplitude Lev New is greater than the maximum level variable Lev, the flow of the processing procedure goes on to a step SP17 at which the maximum level variable Lev is set at the detected amplitude Lev New. Then, the flow of the processing procedure goes back to the step SP13. If the detected amplitude Lev New is not greater than the maximum level variable Lev, on the other hand, the flow of the processing procedure goes back directly to the step SP13.

The central processing unit 5 thus repeatedly executes the processing procedure in the order of the steps SP13–SP14–SP15–SP16–SP13 or the steps SP13–SP14–SP15–SP16–SP17–SP13 to determine the maximum amplitude of a musical file, which is handled as a processing object, from sequentially detected amplitudes of the musical file. As the reproduction of a piece of music is finished, the outcome of the judgment formed at the step SP13 is a negation, which causes the flow of the processing procedure to go on to a step SP18. At this step, the detected maximum amplitude is recorded in the database. Then, at the next step SP19, the processing procedure is ended.

In this way, the central processing unit 5 first decompresses audio data, which was compressed by adopting the ATRAC technique, and then detects a recording level to be stored in the database. It is to be noted that the central processing unit 5 also records a musical file imported by using a sound board or the like into the hard-disc drive 8 as described above.

Figure 1:
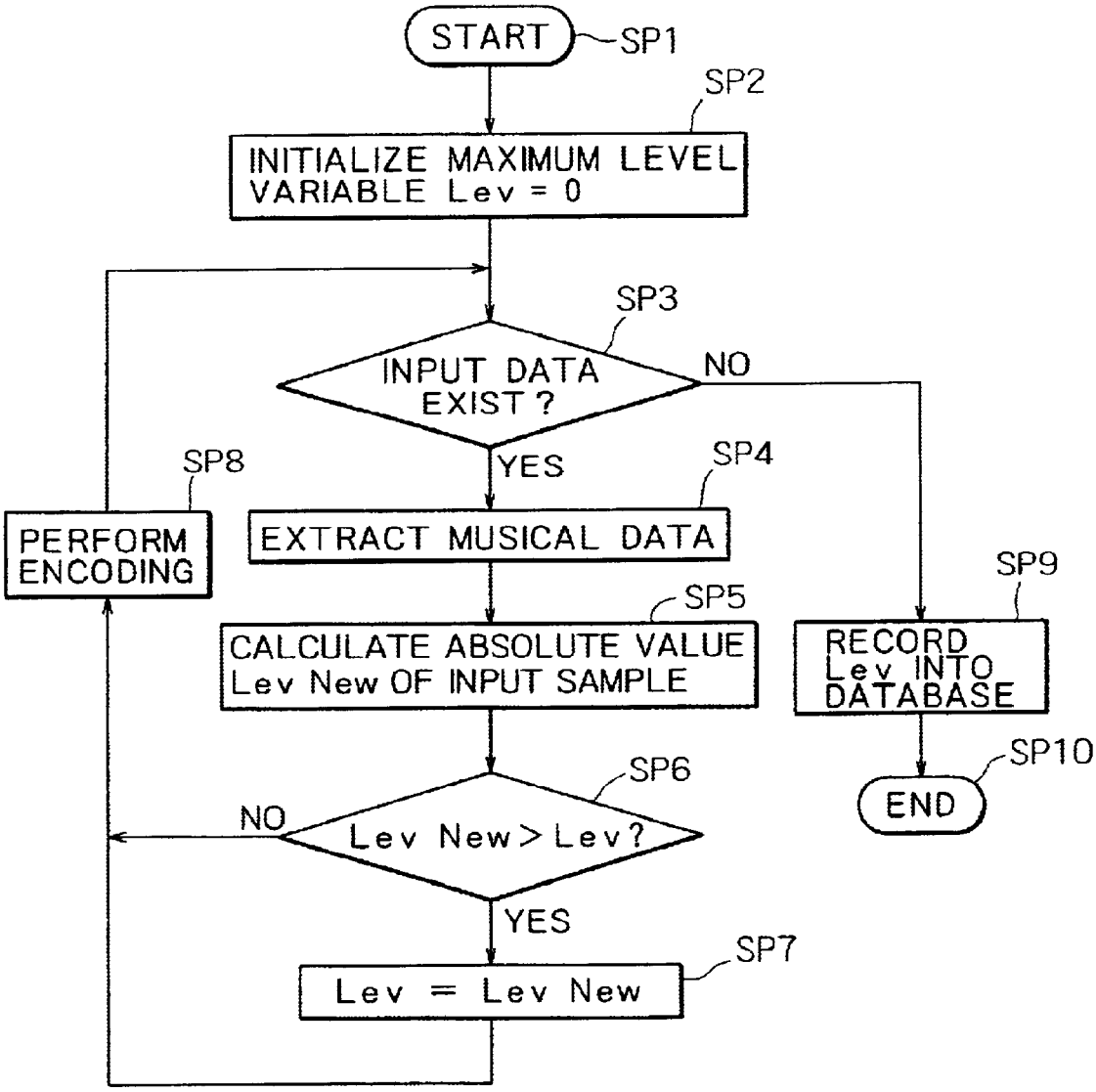
FIG. 1 is a flowchart representing operations carried out by a personal computer in a musical-file-processing system implemented by an embodiment of the present invention.
Figure 5:
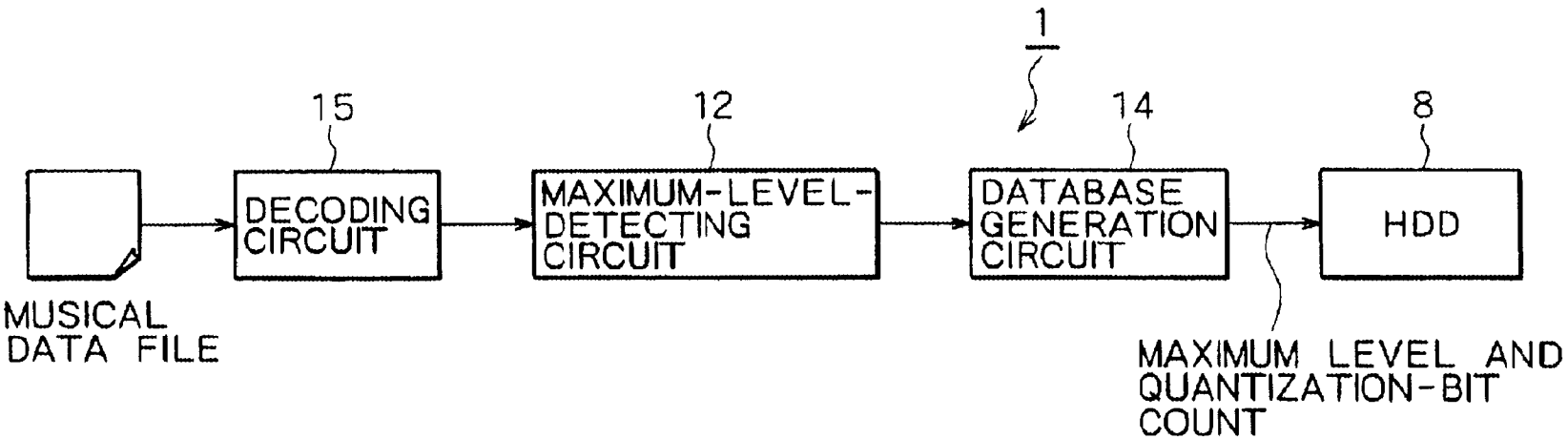
FIG. 5 is a functional block diagram showing the personal computer's components required for carrying out the sequential processing represented by the procedure shown in FIG. 4.

FIG. 5 is a functional block diagram showing components of the personal computer 2 that are required for carrying out the sequential processing represented by the procedure shown in FIG. 4 as the components shown in FIG. 3 are required for carrying out the sequential processing represented by the procedure shown in FIG. 1. In the functional block diagram of FIG. 5, a decoding circuit 15 is a functional block for decompressing audio data, which was compressed by adopting the ATRAC technique.

Figure 6:
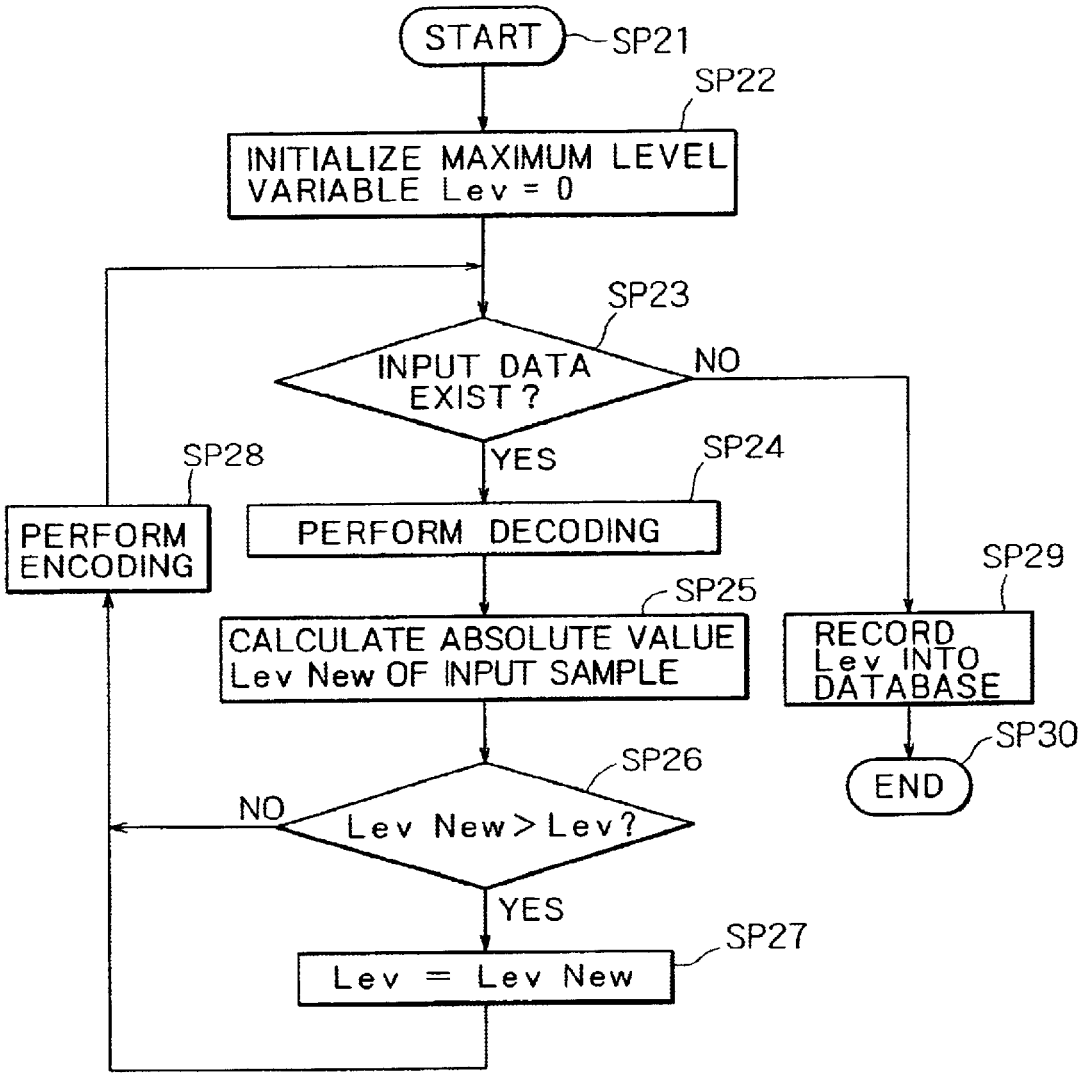
FIG. 6 is a flowchart representing the procedure of processing to convert the format of a musical file in an operation to import the file.

If the user enters a command to import a musical file to the main screen of the application program and the format of the imported musical file is different from the ATRAC format, on the other hand, the central processing unit 5 carries out processing represented by a procedure shown in FIG. 6 to convert the format of the musical file and record the file as well as a recording level thereof into the database for each imported musical file. It is to be noted that a musical file's typical format different from the ATRAC format is typically an MP3 (MPEG1 Audio Layer III) format.

To put it in detail, at a step SP21, the central processing unit 5 starts processing of a musical file specified in an import command entered by the user. Then, at the next step SP22, a maximum level variable Lev is set at an initial value of 0. Subsequently, at the next step SP23, the central processing unit 5 forms a judgment as to whether or not input data has been received. If input data has been received, the flow of the processing procedure goes on to a step SP24 at which audio data serving as an object of the processing is decoded.

Then, at the next step SP25, the central processing unit 5 detects the amplitude Lev New of the decoded audio data. Subsequently, at the next step SP26, the central processing unit 5 forms a judgment as to whether or not the detected amplitude Lev New is greater than the maximum level variable Lev. If the central processing unit 5 finds out that the detected amplitude Lev New is greater than the maximum level variable Lev, the flow of the processing procedure goes on to a step SP27 at which the maximum level variable Lev is set at the detected amplitude Lev New. Then, the flow of the processing procedure goes on to a step SP28. If the detected amplitude Lev New is not greater than the maximum level variable Lev, on the other hand, the flow of the processing procedure goes on directly to the step SP28.

At the step SP28, the central processing unit 5 encodes this audio data into the ATRAC format and records the encoded data onto the hard-disc drive 8. Then, the flow of the processing procedure goes back to the step SP23.

The central processing unit 5 thus repeatedly executes the processing procedure in the order of the steps SP23–SP24–SP25–SP26–SP28–SP23 or the steps SP23–SP24–SP25–SP26–SP27–SP28–SP23 to determine the maximum amplitude of a musical file, which is handled as a processing object. As the reproduction of a piece of music is finished, the outcome of the judgment formed at the step SP23 is a negation, which causes the flow of the processing procedure to go on to a step SP29. At this step, the detected maximum amplitude is recorded in the database. Then, at the next step SP30, the processing procedure is ended.

Figure 7:
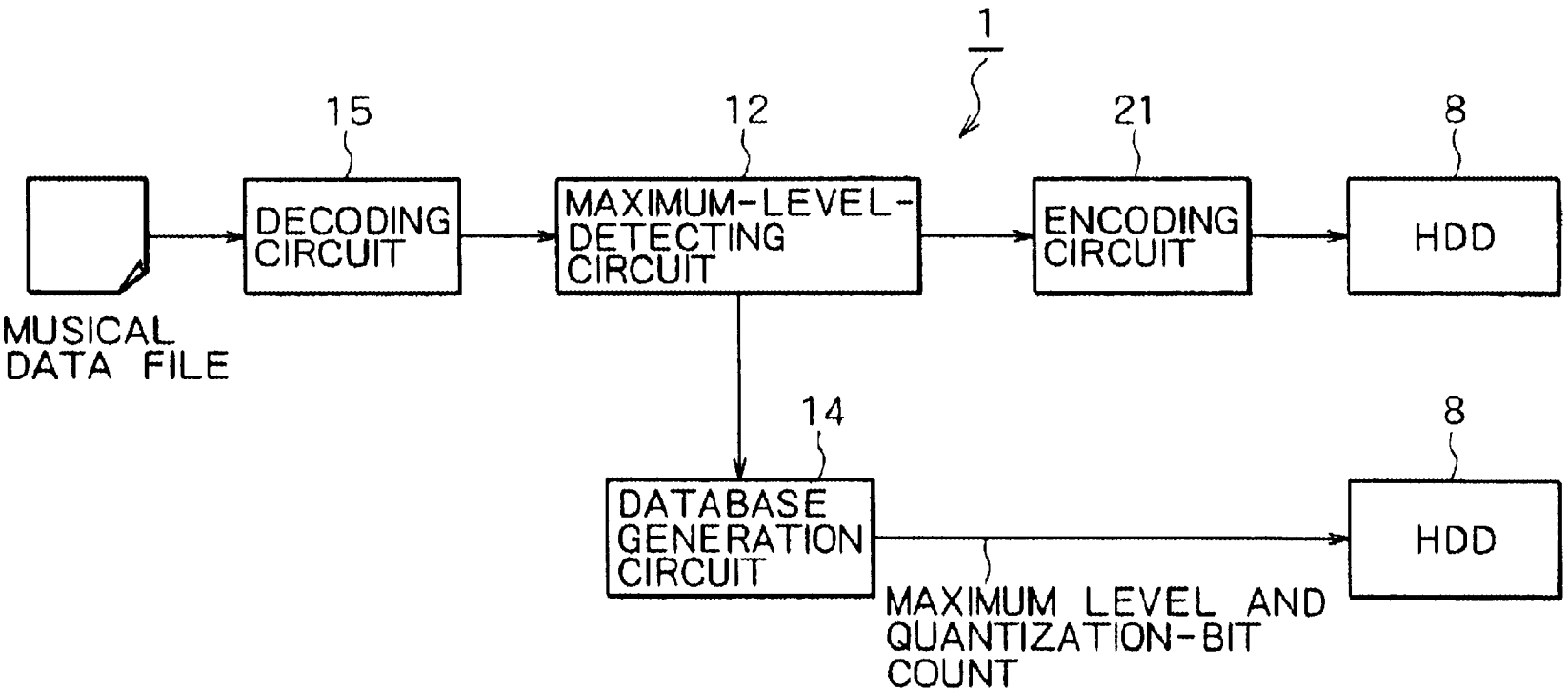
FIG. 7 is a functional block diagram showing the personal computer's components required for carrying out the sequential processing represented by the procedure shown in FIG. 6.

FIG. 7 is a functional block diagram showing components of the personal computer 2 that are required for carrying out the sequential processing represented by the procedure shown in FIG. 6 as the components shown in FIGS. 3 and 5 are required for carrying out the sequential processing represented by the procedures shown in FIGS. 1 and 4 respectively. In the functional block diagram of FIG. 7, an encoding circuit 21 is a functional block for compressing linear-PCM audio data by adoption of the ATRAC technique.

As described above, in this embodiment, a recording level and a quantization-bit count of each musical level are stored in the database.

If the user enters a command to reproduce music to if the main screen of the application program, on the other hand, the central processing unit 5 reproduces musical files on a reproduction list specified in the command in an order of the reproduction list or at random. If the user does not make a request for correction of the volume in particular in this reproduction, the central processing unit 5 controls the entire operation to reproduce the musical files from the hard-disc drive 8 without doing any correction of their volumes. If the user specifies automatic correction of the volumes, on the other hand, the central processing unit 5 carries out processing represented by a procedure shown in FIG. 8 in order to reproduce the musical files by adjusting their volumes automatically in accordance with results of detection of the musical files' recording levels.

To put it in detail, at a step SP31, the central processing unit 5 starts the processing to reproduce a musical file. Then, at the next step SP32, the central processing unit 5 calculates a correction factor. For a musical file, a correction factor is calculated from a maximum level and a quantization-bit count, which are stored in the database for the musical file, so that, with the calculated correction factor, the maximum amplitude of the musical file is appropriated for the quantization-bit count, that is, the musical files can be listened to at about the same volume, and the dynamic range is fully utilized by the reproduced musical files.

After the central processing unit 5 calculates a correction factor for the musical file serving as an object for reproduction as described above, the flow of the processing procedure goes on to a step SP33 to form a judgment as to whether or not data to be decoded exists. If data to be decoded exists, the flow of the processing procedure goes on to a step SP34 at which the central processing unit 5 decodes the musical file serving as an object or reproduction by a predetermined amount of data to generate linear-PCM audio data. Then, at the next step SP35, the volume of the musical file is corrected by multiplying this data by the correction factor. Subsequently, at the next step SP36, the audio data with a corrected volume is output to the audio device 7. Then, the flow of the processing procedure goes back to the step SP33.

The central processing unit 5 thus repeatedly executes the processing procedure in the order of the steps SP33–SP34–SP35–SP36–SP33. As the reproduction of a piece of music is finished, the outcome of the judgment formed at the step SP33 is a negation, which causes the flow of the processing procedure to go on to a step SP37 to end the processing procedure.

In this way, on the basis of results of detection of recording levels detected at an operation to record musical files into the database, the central processing unit 5 is capable of reproducing the musical files with corrected volumes so that the dynamic range is fully utilized and the musical files are reproduced as an all but constant volume.

Figure 8:
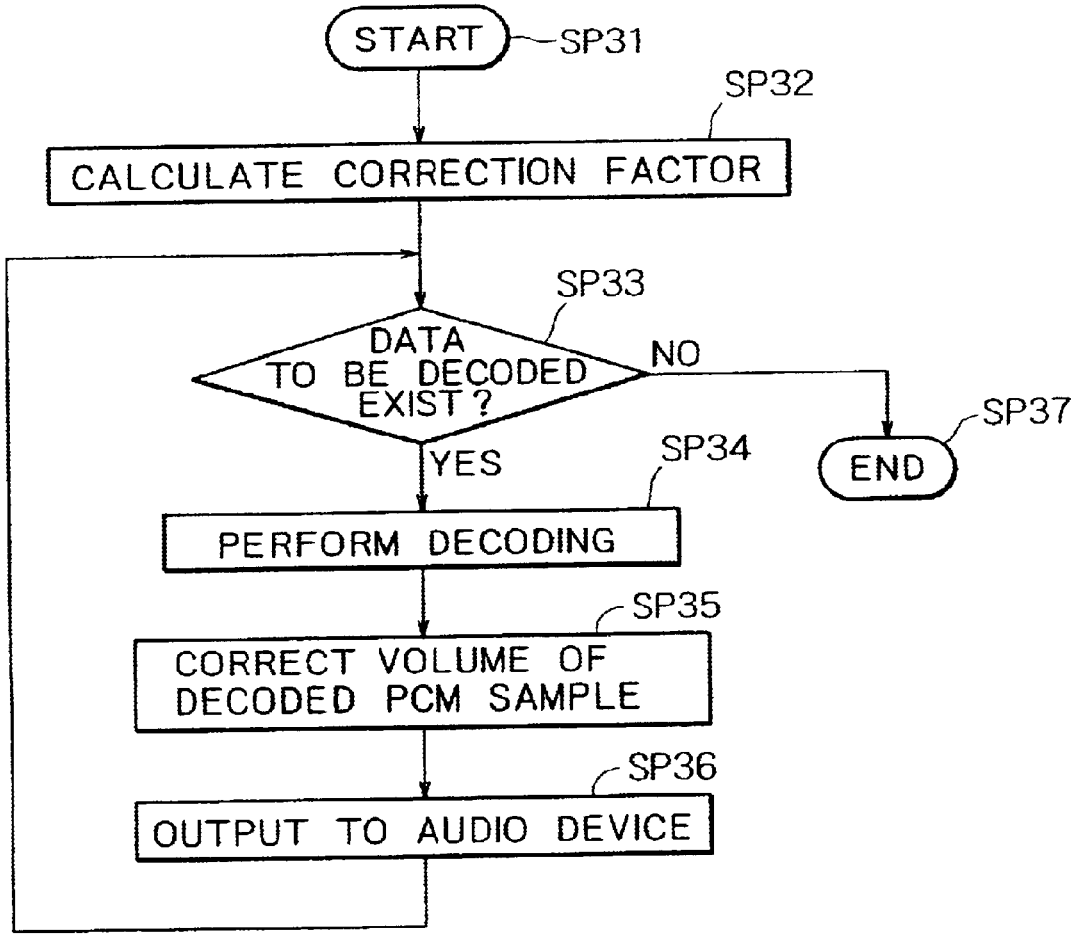
FIG. 8 is a flowchart representing the procedure of processing to reproduce a musical file.
Figure 9:
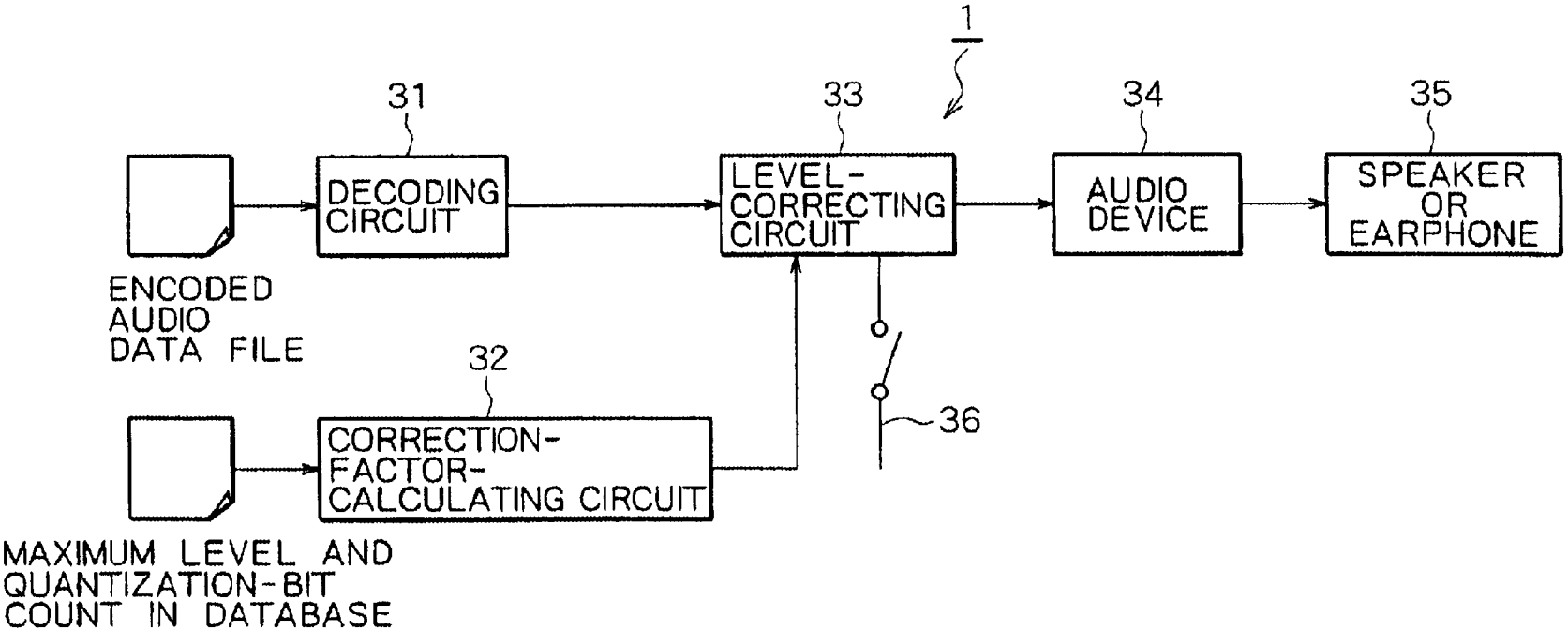
FIG. 9 is a functional block diagram showing the personal computer's components required for carrying out the sequential processing represented by the procedure shown in FIG. 8.

FIG. 9 is a functional block diagram showing components of the personal computer 2 that are required for carrying out the sequential processing represented by the procedure shown in FIG. 8. In the functional block diagram of FIG. 9, a decoding circuit 31 is a functional block for decompressing data of a musical file, which was compressed by adoption of the ATRAC technique, to generate linear-PCM audio data. A correction-factor-calculating circuit 32 is a functional block for calculating a correction factor. A level-correcting circuit 33 is a functional block for correcting the volume of PCM linear audio data by multiplying the data by a correction factor calculated for the data. A switch circuit 36 is a functional block for controlling an operation to disable and enable the level-correcting circuit 33.

Figure 10:
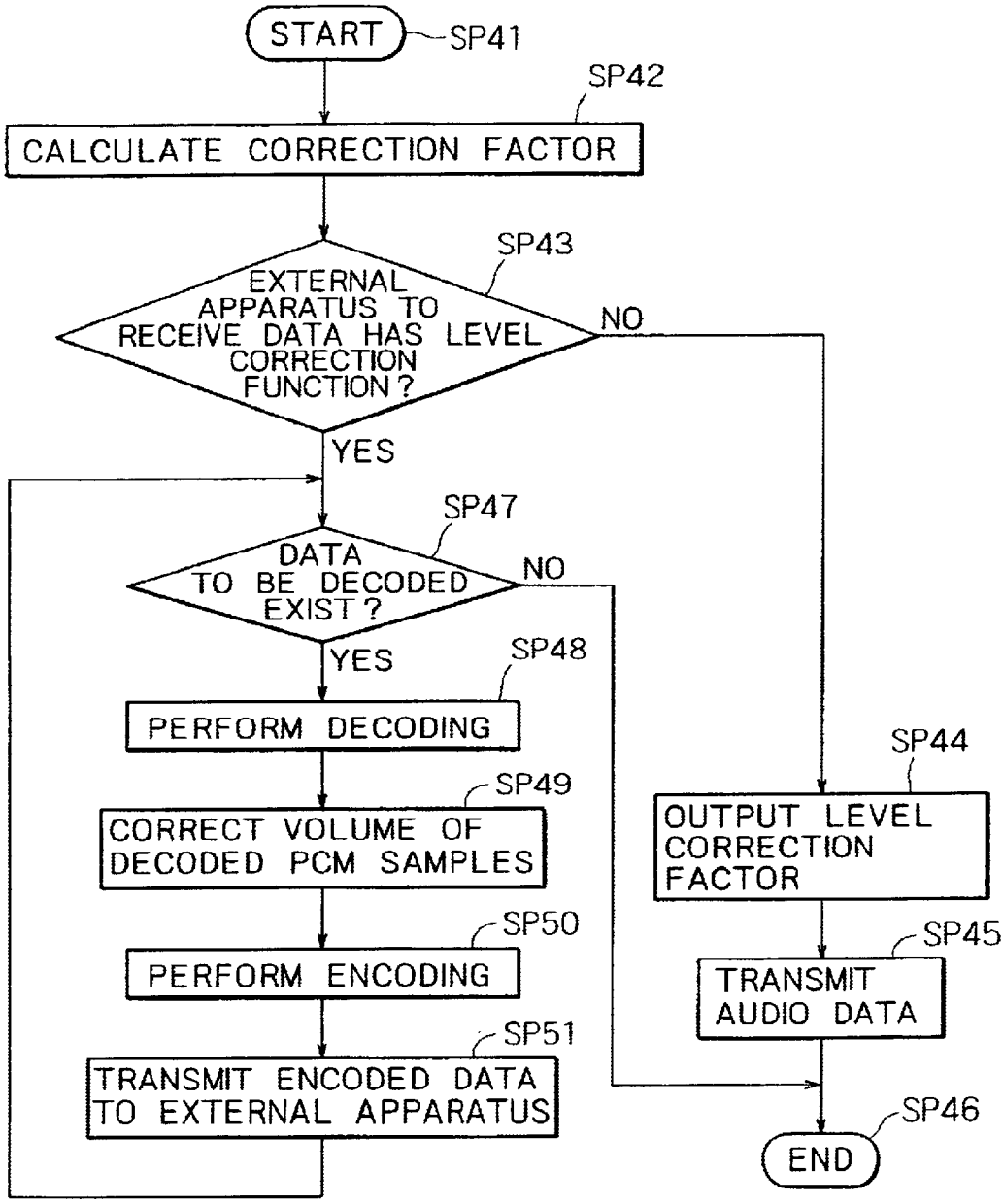
FIG. 10 is a flowchart representing the procedure of processing to download a musical file.

In accordance with a command given by the user, a musical file can also be downloaded to the external reproduction apparatus 3, which is normally a portable reproduction apparatus for reproducing a musical file. In this case, for each musical file, the central processing unit 5 carries out processing represented by a flowchart shown in FIG. 10 in order to download the file to the external reproduction apparatus 3 by correcting the volume of the file.

To put it in detail, the processing begins with a step SP41. Then, at the next step SP42, the central processing unit 5 calculates a correction factor of the volume in the same way as described above by referring to FIG. 8. Subsequently, at the next step SP43, the central processing unit 5 forms a judgment as to whether or not the external reproduction apparatus 3 has a level correction function, which is a function for correcting the volume of linear-PCM audio data by multiplying the linear-PCM audio data by the correction factor.

If the external reproduction apparatus 3 has a level correction function, the flow of the processing procedure goes on from the step SP43 to a step SP44 at which the central processing unit 5 outputs the correction factor calculated at the step SP42 to the external reproduction apparatus 3 as side information attached to the musical file. Then, at the next step S45, the musical file associated with the correction factor is downloaded to the external reproduction apparatus 3. Subsequently, at the next step S46, this processing is ended.

Figure 11:
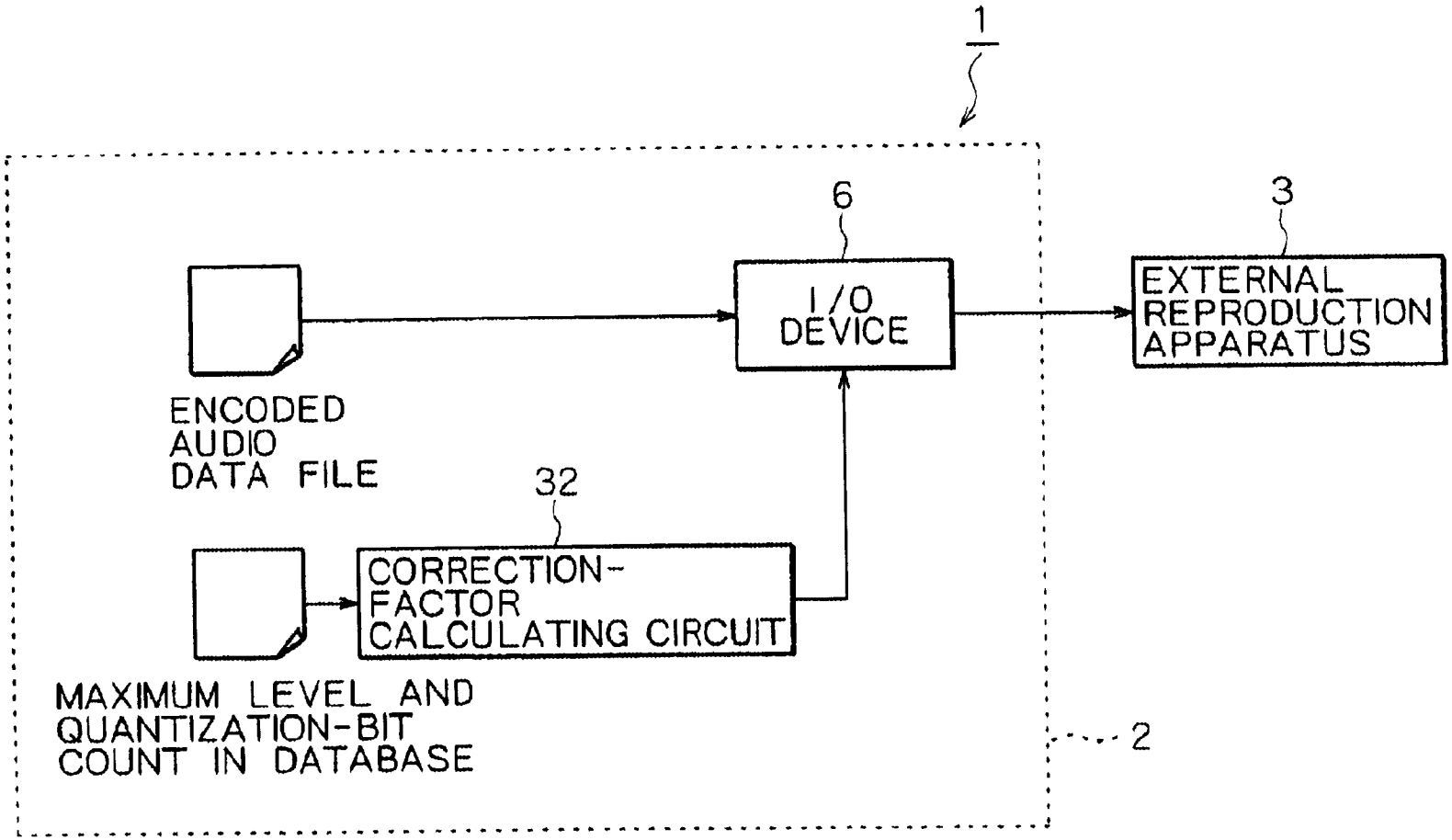
FIG. 11 is a functional block diagram showing the personal computer's components required for carrying out the sequential processing represented by the procedure shown in FIG. 10 with no correcting of the volume.

FIG. 11 is a functional block diagram showing components of the personal computer 2 that are required for carrying out the sequential processing explained above to be compared with the functional block diagram of FIG. 9 showing components of the personal computer 2 that are required for carrying out the sequential processing represented by the procedure shown in FIG. 8. In this case, in the external reproduction apparatus 3, linear-PCM audio data obtained as a result of decoding of a musical file is multiplied by a correction factor downloaded along with the musical file as described above to correct the volume of the file. Then, the musical file is subjected to digital-to-analog conversion processing before being used for driving a speaker or earphones.

If the external reproduction apparatus 3 does not have a level correction function, on the other hand, the flow of the processing procedure goes on from the step SP43 to a step SP47 to form a judgment as to whether or not data to be decoded exists. If data to be decoded exists, the flow of the processing procedure flows to a step SP48 at which the central processing unit 5 decodes the musical file by a predetermined amount of data to generate linear-PCM audio data. Then, at the next step S49, the volume of the audio data is corrected by multiplying this data by the correction factor. Subsequently, at the next step SP50, the audio data is encoded into the ATRAC format. Then, at the next step SP51, the encoded data is transmitted to the external reproduction apparatus 3. Subsequently, the flow of the processing procedure goes back to the step S47.

The central processing unit 5 thus repeatedly executes the processing procedure in the order of the steps SP47–SP48–SP49–SP50–SP51–SP47. As the reproduction of a piece of music is finished, the outcome of the judgment formed at the step SP47 is negative, which causes the flow of the processing procedure to go on to the step SP46 to end the processing procedure.

Thus, in the case of an external reproduction apparatus having no level correction function, the central processing unit 5 fully utilizes the dynamic range and corrects the volumes of musical files so that the user can listen to the files at all but the same volume before outputting the musical files to the external reproduction apparatus 3.

Figure 12:
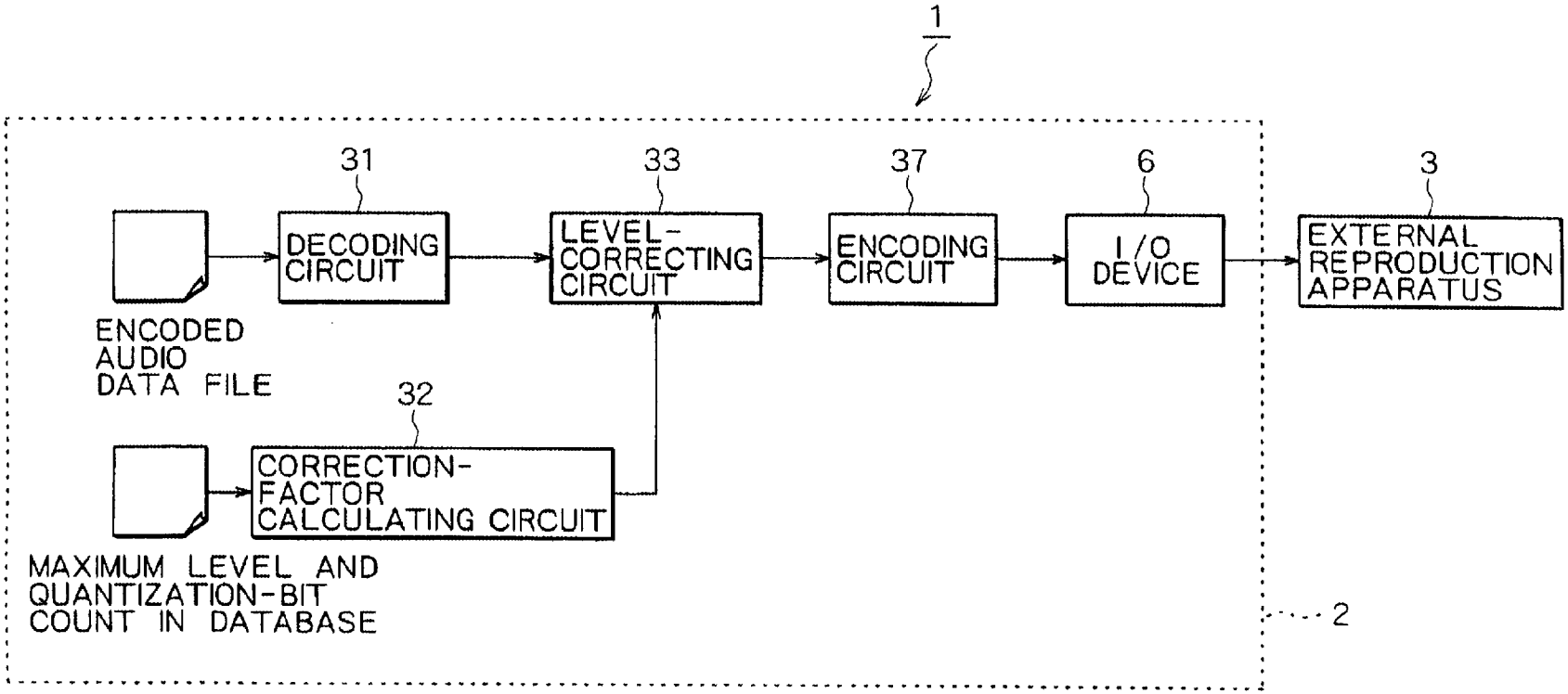
FIG. 12 is a functional block diagram showing the personal computer's components required far carrying out the sequential processing represented by the procedure shown in FIG. 10 with correction of the volume.

FIG. 12 is a functional block diagram showing components of the personal computer 2 to be compared with the functional block diagram of FIG. 9 and FIG. 11. In the functional block diagram of FIG. 12, a decoding circuit 31 is a functional block for decompressing data of a musical file, which was compressed by adoption of the ATRAC technique, to generate linear-PCM audio data. An encoding circuit 37 is a functional block for compressing linear-PCM audio data in accordance with the ATRAC technique.

If the user enters a command to download a musical file with a corrected volume to a CD-R, the central processing unit 5 decodes data of a musical file by adoption of the ATRAC technique to generate linear-PCM audio data, and corrects the volume of the audio data by multiplying the data by a correction factor in the same way as the operation to download a musical file to an external apparatus having no level correction function. The audio data with a corrected volume is then output to the CD-ROM drive 4 to be recorded onto the CD-R. If the user enters a command to download a musical file with no volume correction to a CD-R, on the other hand, the central processing unit 5 decodes data of a musical file by adoption of the ATRAC technique to generate linear-PCM audio data, and records the audio data onto the CD-R along with a correction factor in the same way as the operation to download a musical file to an external apparatus having a level correction function.

If the user enters a command to convert the format of a musical file and correct the volume of the musical file, the central processing unit 5 decodes data of a musical file, which was coded by adoption of the ATRAC technique, to generate linear-PCM audio data, and corrects the volume of the audio data by multiplying the data by a correction factor in the same way as the operation to download a musical file to an external apparatus having no level correction function. The central processing unit 5 then converts the format of the audio data with a corrected volume into a format specified by the user to generate a musical file.

In the musical-file-processing system 1 with the configuration described above, a musical file presented by using a compact disc and a musical file downloaded by way of the Internet are recorded onto the hard-disc drive 8. These musical files are sequentially reproduced in accordance with a command entered by the user and output to typically a speaker or downloaded to the external reproduction apparatus 3.

In an application program executed by the musical-file-processing system 1 to carry out this processing sequence, for each musical file, a maximum amplitude of linear-PCM audio data is detected in an operation to receive the musical file so that the musical file can be used on the basis of the detected maximum amplitude, which is also stored in a database in the hard-disc drive 8 as a criterion of recording levels. At the same time, a quantization-bit count is also stored in the hard-disc drive 8 as well. In addition, linear-PCM audio data of a musical file is compressed into a predetermined format before being stored in the hard-disc drive 8. As for a musical file containing data compressed into a different format, the data is first transformed into linear-PCM audio data, which is then compressed into the predetermined format before being stored in the hard-disc drive 8.

Assume that a musical file recorded in the personal computer 2 as described above is reproduced for a listening purpose. In this case, the volume of the audio data is corrected by multiplying the audio data by a correction factor calculated on the basis of the recording level detected for the musical file as described above and the quantization-bit count of the audio file so as to fully utilize a dynamic range. Thus, musical files can be reproduced at an all but uniform volume. The PCM linear audio data is finally subjected to digital-to-analog conversion prior to presentation of the data to the user.

As a result, the user is capable of listening to reproduced musical files without the need to carry out cumbersome operations even if the musical files have been recorded at different recording levels. Accordingly, the easiness of musical-file usage is much improved in comparison with the conventional system. In addition, by reproducing a musical file through full utilization of the dynamic range, it is possible to prevent the music quality from deteriorating in the reproduction system including the digital-to-analog conversion circuit and an amplification circuit.

In addition, by storing criteria of recording levels in a database as described above, a criterion of a desired musical file can be found in a short period of time so that processing for the file can be carried out by using the criterion.

Furthermore, a musical file recorded in the hard disc drive 8 without an operation to adjust its volume can be reproduced by adjusting the volume so that the so-called operation to record a musical file in its original state can be implemented. With such an operation implemented, the user can reproduce a musical file in processing, which the user likes, such as the so-called reproduction at an original recording level.

That is to say, a musical work such as the musical file described above may possibly be stored at an intentionally reduced recording level. In this case, when the user enters a command to the personal computer 2 employed in the musical-file-processing system 1 to reproduce such a musical file without adjustment of its volume, the reproduced data of the musical file is decompressed without any adjustment of its volume to generate linear-PCM audio data, which is then subjected to digital-to-analog conversion before being output to typically a speaker. Thus, it is possible to present a variety of musical works to the user by maintaining their original atmospheres as they are.

If the user enters a command to download a musical file to the external reproduction apparatus 3, which has the volume correction function, in the musical-file-processing system 1, the musical file is downloaded to the external reproduction apparatus 3 along with the correction amplifier for the file. Then, in an operation carried out by the external reproduction apparatus 3 to reproduce a downloaded musical file, the data of the musical file is decompressed to generate linear-PCM audio data, the volume of which is then corrected by multiplying the data by the correction factor for the musical file, and the audio data with a corrected volume is subsequently subjected to digital-to-analog conversion before being output to typically a speaker.

Thus, when enjoying music reproduced from an external reproduction apparatus, it is possible to fully utilize the dynamic range and reproduce musical files at all but the same volume. Thus, the easiness of musical-file usage can be much improved in comparison with the conventional system. In addition, a musical file can be reproduced by fully utilizing the dynamic range.

When the user enters a command to download a musical file to an external reproduction apparatus 3 having no such volume-adjusting function and to correct the volume of the musical file, on the other hand, the volume is corrected by multiplying a correction factor by linear-PCM audio data obtained as a result of decompression of data of the musical file, the audio data with the corrected volume is again compressed and a musical file, which is obtained as a result of the compression and has the corrected volume, is downloaded to the external reproduction apparatus 3.

As a result, even in the case where the user wants to enjoy musical files by using an external reproduction apparatus 3 having a simple configuration with no such volume-adjusting function, it is possible to fully utilize the dynamic range and reproduce musical files at all but the same volume. Thus, the easiness of musical-file usage can be much improved in comparison with the conventional system.

When the user enters a command to download a musical file to an external reproduction apparatus 3 having no such volume-adjusting function without correcting the volume of the musical file, on the other hand, the musical file specified in the command entered by the user is merely downloaded to the external reproduction apparatus 3. Thus, it is possible to present a variety of musical works to the user by maintaining their original atmospheres as they are.

In addition, when the user enters a command to download a musical file to a CD-R in place of such an external reproduction apparatus 3, convert the format of the musical file and correct the volume, the volume is corrected by multiplying a correction factor by linear-PCM audio data obtained as a result of decompression of data of the musical file. Then, the audio data with the volume corrected in this way is processed in accordance with the command entered by the user.

Thus, also in this case, in the subsequent processing, it is possible to fully utilize the dynamic range and reproduce musical files at all but the same volume. As a result, the easiness of musical-file usage can be much improved in comparison with the conventional system.

If the user enters a command to download a musical file to a CD-R and convert the format of the musical file without correction of the volume, on the other hand, the processing to multiply the linear-PCM audio data by the correction factor is omitted. As a result, it is possible to present a variety of musical works to the user by maintaining their original atmospheres as they are.

In accordance with the configurations described above, musical files are recorded by detecting a recording volume for each of the musical files and any specific musical file is reproduced by correcting the volume of the file on the basis of the recording level detected for the specific musical file. Thus, complicated operations can be eliminated effectively and musical files having different recording levels can be reproduced at an appropriate volume.

In addition, a maximum amplitude of a musical file is detected as the recording level for the musical file. Thus, a recording level can be detected in simple processing. As a result, the whole configuration can also be made simple as well.

In the embodiment described above, a criterion of the recording level is set at a maximum amplitude. It should be noted, however, that the scope of the present invention is not limited to this embodiment. If necessary, the criterion of the recording level can be set at any one of a variety of other quantities such as an average power and an average amplitude.

In addition, in the embodiment described above, results of detection of recording levels are stored in a database. It is worth noting, however, that the scope of the present invention is not limited to this embodiment. For example, the results of detection can be recorded by associating them with their respective musical files to give the same effects as this embodiment.

Furthermore, in the embodiment described above, when outputting a musical file to an external reproduction apparatus without correcting the volume, a correction factor is calculated and outputted along with the musical file. It should be noted, however, that the scope of the present invention is not limited to this embodiment. For example, a result of detection of a recording level for the musical file can also be outputted instead along the musical file.

Moreover, in the embodiment described above, a musical file is stored in its original state as it is. However, the scope of the present invention is not limited to this embodiment. For example, a musical file can also be stored with the volume thereof adjusted in advance.

In addition, in the embodiment described above, the present invention is applied to a personal computer. It should be noted, however, that the scope of the present invention is not limited to this embodiment. For example, the present invention can also be applied to a great variety of audio apparatus such as a home network server for storing musical contents to be presented to users.

As described above, in accordance with the present invention, each musical file is recorded by detecting a recording level for the file. Thus, by correcting the volume on the basis of the recording level detected in this way, complex operations can be avoided and musical files with different recording levels can be reproduced at a proper volume.

While a preferred embodiment of the present invention has been described using specific terms, such description is for illustrative purposes only, and it is to be understood that changes and variations may be made without departing from the spirit or scope of the following claims.

What is claimed is:

1. A musical-file-processing apparatus for acquiring and storing a musical file, comprising a detecting element that detects a recording level of each musical file; and a recording element that records the detected recording level in association with a corresponding musical file.

2. The musical-file-processing apparatus according to claim 1, wherein the recording level of the musical file is a maximum amplitude of the musical file.

3. The musical-file-processing apparatus according to claim 1, wherein a musical file volume is corrected by using the detected recording level corresponding to the musical file before being outputted to an external apparatus.

4. The musical-file-processing apparatus according to claim 1, wherein a musical file volume is corrected by using the detected recording level corresponding to the musical file in an operation to reproduce the musical file.

5. The musical-file-processing apparatus according to claim 1, wherein a musical file volume is corrected by using the detected recording level corresponding to the musical file in an operation to record the musical file.

6. The musical-file-processing apparatus according to claim 1, wherein the detected recording level is outputted along with the corresponding musical file.

7. A musical-file-processing apparatus for reproducing a musical file, comprising a reproducing element for reproducing a musical file with a corrected volume in accordance with a detected recording level for the musical file.

8. A musical-file-processing method for acquiring and storing a musical file, comprising:

detecting a recording level for each musical file; and associating the musical file with said detected recording level.

9. A musical-file-processing method for reproducing a musical file, comprising:

detecting a recording level of a musical file; and reproducing said musical file with corrected volume in accordance with said detected recording level.

10. A program implementing a musical-file-processing method according to claim 8.

11. A program implementing a musical-file-processing method according to claim 9.

* * * * *